US005802792A

United States Patent [19]

Fielding et al.

[11] Patent Number: 5,802,792

[45] Date of Patent: Sep. 8, 1998

[54] DRYWALL CONSTRUCTION AND MEANS THEREFOR

[76] Inventors: David W. Fielding, 131 Yonge Blvd., Toronto, Ontario, Canada, M3S 3H2; Clifford E. Van Steinburg, 48 Catalina Drive, Scarborough, Ontario, Canada, M1M 1K6

[21] Appl. No.: 716,549

[22] Filed: Sep. 19, 1996

[30] Foreign Application Priority Data

Sep. 21, 1995 [CA] Canada ..... 2158771

[51] Int. Cl.[6] ..... E04B 1/62

[52] U.S. Cl. ..... 52/396.09; 52/396.08; 52/585.1; 52/745.05

[58] Field of Search ..... 52/604, 223.7, 52/393, 396.08, 396.09, 585.1, 742.1, 742.12, 745.21, 747.1, 745.05; 446/118

[56] References Cited

U.S. PATENT DOCUMENTS

| | | | |
|---|---|---|---|
| 849,144 | 4/1907 | Lauer | 52/604 |
| 1,496,754 | 6/1924 | Eaves | 52/604 |
| 1,637,657 | 8/1927 | Riegel | 52/604 |
| 2,006,462 | 7/1935 | Kupper | 446/118 |
| 2,199,112 | 4/1940 | O'Leary | 52/604 |
| 2,472,221 | 6/1949 | Malthouse | 52/604 |
| 2,483,560 | 10/1949 | Peterson | 52/604 |
| 3,296,758 | 1/1967 | Knudsen | 52/223.7 |
| 4,426,815 | 1/1984 | Brown | 52/100 |
| 4,429,499 | 2/1984 | Kato | 52/223.7 |
| 4,899,512 | 2/1990 | DeGooyer | 52/396.08 |

*Primary Examiner*—Beth Aubrey
*Attorney, Agent, or Firm*—C. E. Van Steinburg

[57] ABSTRACT

The invention is directed to a block or brick drywall construction which simulates a mortared block or brick wall construction by the use of simulated horizontal mortar layer inserts between stacked rows of blocks and vertical inserts between abutting ends of blocks in each row, the horizontal layer insert being in the form of a belt provided with longitudinally spaced holes which coincide with vertical holes Provided in the blocks and the abutment spaces between blocks, there being short pins passing through the holes of the belt layer and penetrating into the coinciding holes in the building blocks lying immediately above and below the belt, each belt layer being used in conjunction with a separate set of pins, the belt layer being substantially non-compressible whereas the vertical inserts are somewhat resilient in order to facilitate some longitudinal adjustment in the placement of blocks in abutting relationship.

11 Claims, 3 Drawing Sheets

DRYWALL CONSTRUCTION AND MEANS THEREFOR

FIELD OF THE INVENTION

This invention relates to block-type drywall construction and, more particularly to a brick drywall construction method and the means for carrying it out. Although the method and means are applicable to building blocks in general, i.e. bricks and concrete blocks, the construction is preferably of brick. The constructed wall is designed to be, essentially, self supporting and simulate the appearance of a brick wall of normal mortared construction.

DISCUSSION OF THE PRIOR ART

Drywall constructions are used generally and take the form of a wall constructed of unitary building units or blocks which can be stacked to provide a self supporting wall structure. A securing cement, or mortar, being dispensed with.

U.S. Pat. No. 5,048,250—Ellias, issued Sep. 17, 1991, is directed to a building block per se which is designed for stacking in a drywall structure. The blocks are provided with vertically oriented holes, which in stacking are vertically aligned through row layers, through which rods may be passed to provide reinforcement of the structure.

U.S. Pat. No. 4,426,815—Brown, issued Jan. 26, 1984, is directed to a mortarless concrete building block provided with key means locking one layer of blocks to the underlying or overlying next layer. Here again reinforcing rods may be used for added strength.

U.S. Pat. No. 2,199,112—O'Leary, issued Apr. 30, 1940, is directed to an insulated building block having, in one instance, a simulated brick construction surface applied to the face of the block.

U.S. Pat. No. 2,006,462—Kupper, issued Jul. 2, 1935, is directed to a miniature building system wherein individual building blocks are mounted on and secured by vertical rods passing consecutively through layers of the blocks.

GENERAL DESCRIPTION OF THE INVENTION

The present invention is directed to a drywall construction method and means facilitating ease of construction while, at the same time, providing a strong structure with the appearance of a mortared block wall. The preferred construction block is a standard brick presently in wide use for building and wall construction.

According to the invention, the layers of brick, in regular construction format, are interleaved with relatively thin layers of preferably, a slightly resilient belt-like material which provides the appearance of a mortar strip between the layers. The standard construction brick, upon which the present description is largely based, is provided with holes, usually three, passing vertically through the brick with the holes symmetrically situated so that the holes of offset brick layers will align between layers with, in the case of the three hole brick, the center hole coinciding vertically with the abutting ends of the bricks in the layers immediately above and below that particular center hole. Simulated vertical mortar pads are inserted between abutting brick ends.

A particular feature of the invention is the use of short pin members, for instance tubes, which are dimensioned to fit snugly into the holes in the brick. The length of the pin member is preferably substantially equal to the vertical height of a brick and is inserted into the hole of a brick to the approximate extent of half its length, the other half of the pin member acting as a locating pin upon which the subsequent layer of simulated mortar and bricks are laid. In order to accommodate the pins and, as will appear later the vertical simulated mortar inserts, the horizontal belt layer is provided with transverse-centrally located holes coinciding with the holes in the bricks and the over- and underlying abutting brick ends. The pin members act as means for securing the brick and belt layers against horizontal displacement with respect to each other. In addition, the rods, in view of their snug fits in the brick holes, provide an additional degree of vertical stability. When the pins are tubular in form, vertical reinforcing rods may be readily inserted through a number of laid layers of bricks and insulating belts.

This type of wall construction reduces labor costs in the building of wall etc., is economical and, in view of the fact there are no rigid joints the wall may be subjected to considerable vibrational stress without consequent cracking and deterioration thus rendering the construction useful for earthquake prone areas.

DESCRIPTION OF THE PREFERRED EMBODIMENT

Figure 1:
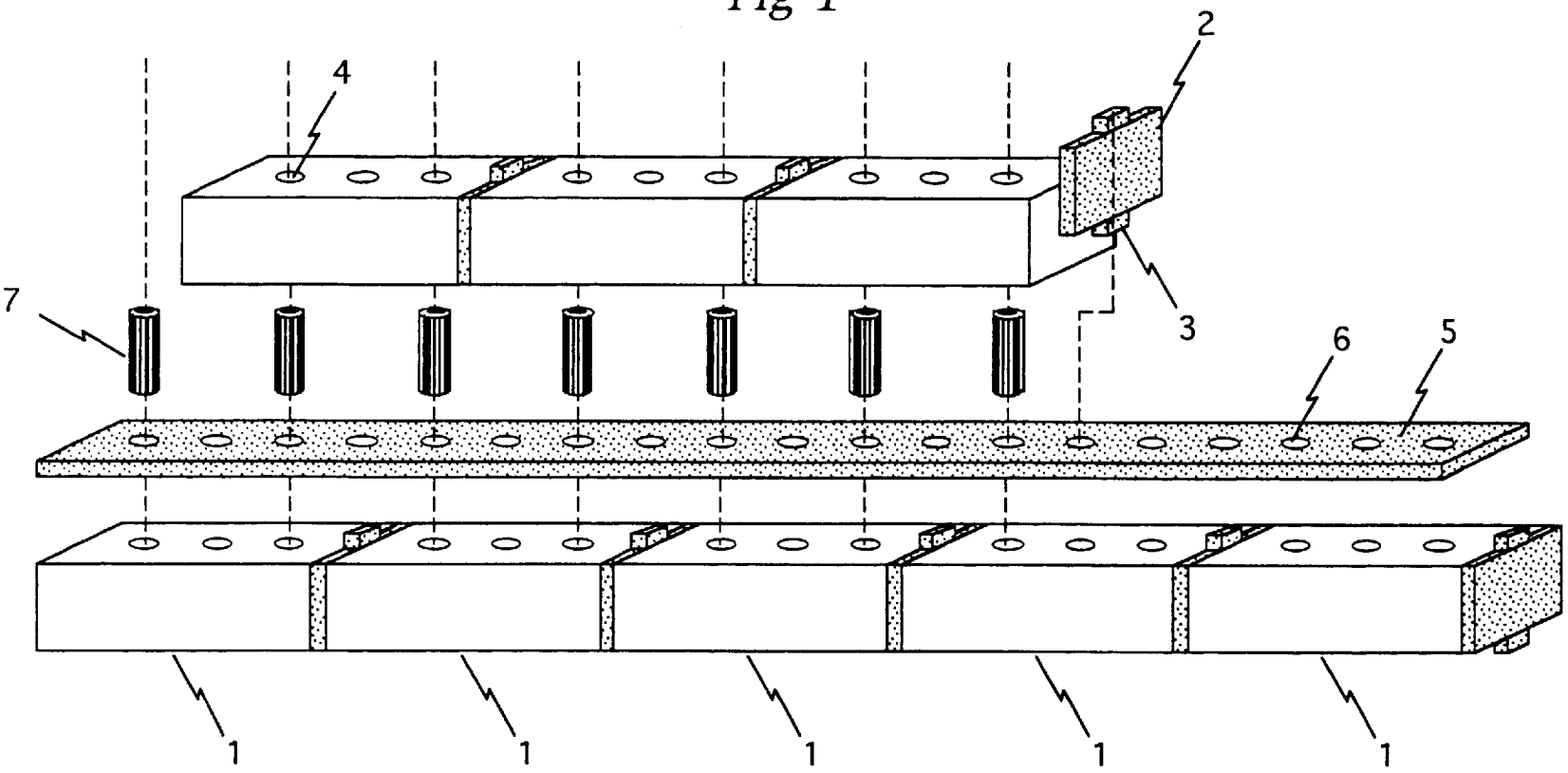
FIG. 1 shows an exploded view of a brick drywall construction according to the present invention.

Referring to FIG. 1 which shows an exploded view of the brick or block wall according to the present invention two horizontal rows of bricks 1, laid end to end in standard brick wall construction, are shown in horizontally offset position whereat the abutment of two bricks in the upper layer overlies the center of a brick immediately below. The bricks are of a known standard form and which, in this instance, are provided with a longitudinal series of three equally spaced and longitudinally separated holes 4 which pass vertically through the brick, the center hole of the series being located centrally of the brick and the longitudinal spacing of the holes is such that, if the series of holes was continued, the subsequent hole center-lines would substantially coincide with the end surfaces of the brick.

The bricks of each row are horizontally separated, according to the invention, by an insert 2 having the dimensions of a mortar separation layer. The inserts simulate the appearance of mortar and may be colored as desired. The insert is, preferably, provided with centrally located, rectangular, upper and lower tabs 3 which are dimensioned so that the horizontal widths thereof substantially equal the diameter of the vertical holes 4 in the bricks 1. The purpose of these tabs will become apparent as the description proceeds.

A belt 5, having a simulated mortar appearance and colored as desired, is provided with a longitudinal series of holes 6 which are longitudinally spaced in accordance with the spacing of the holes in the standard brick 1 and have diameters equal to that of the holes in the brick. The belt 5 is laid between the layers or rows of bricks 1 with the holes 6 of the belt overlying the holes 4 of the bricks. Since the spacings of the holes in the standard brick are such that, when the bricks are laid in standard horizontal-row construction format, the center hole of a brick will coincide, longitudinally of the row, with the center of the abutment space of the rows of bricks immediately above and below that center hole. As a consequence, the belt 5, when positioned on a brick row will have a hole therein which coincides with the abutment space of that row. The purpose of the tabs on the inserts 2 will now become apparent as the belts 5, above and below an insert 2, will provide a hole 6 which will accept the tabs 3 of the insert 2. The insert 2 is, accordingly, secured between the belt layers 5 by the tabs 3. Although the tabs could be dispensed with, it is preferred that the tabs are present to secure the inserts 2 in position.

In order to secure the belts in position between brick layers and provide stability to the construction, pins 7 are provided. The pins 7, preferably, have a diameter substantially equal to that of the holes 4 and a length approximating the thickness of a layer of bricks and one layer of belt 5. The pins 7, preferably, have, at least, a somewhat resilient surface whereby slight imperfections in the brick holes 4 will not prevent a pin 7 from entering thereinto. In constructing a wall, according to the method and system of the invention, the pins 7, are tapped through a belt layer into the brick layer below leaving approximately one half the pin length projecting above the belt.

Figure 2:
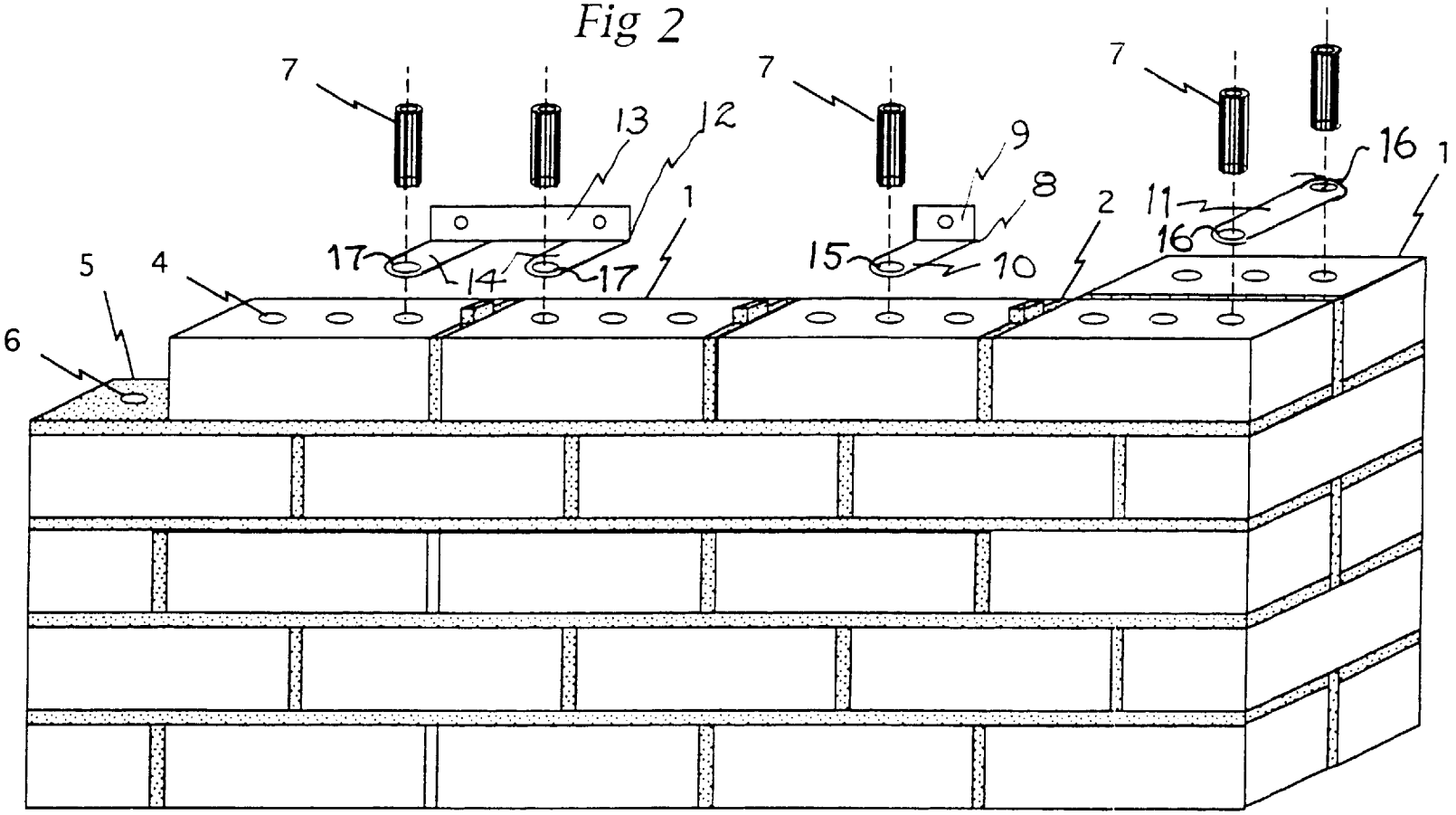
FIG. 2 shows an exploded view of a foundation form for the brick wall construction of FIG. 1, FIGS. 3, 4 and 5 show alternate forms of rod members which may be substituted for the rod members shown in FIG. 1.

The positioning of the pins 7 in the belt can be best seen in FIG. 2 which depicts the starter layer or foundation for the brick wall. In this figure a concrete foundation slab 8, having a longitudinal key slot 9, is shown. The depth of the key is equal to one half the thickness of a brick 1 and pins 7 are placed in belt 5 in alternate holes 6, i.e. spaced by one belt hole 6 and projecting into key slot 9. The pins in this starter row can placed in groups of three to determine the position of the bricks 1, of the starter row. However, the pins 7, when regularly spaced apart by one hole of belt 5, allow for flexibility in the placement of the first row of bricks 1. The bricks 1 of a first layer of bricks are placed each on two pins. This automatically spaces the bricks 1, of the first layer, to accept horizontal spacers 2 therebetween with the lower tabs 3 of the spacers 2 in the holes of belt 5 which do not contain a pin 7. It should be noted that the pins 7 project above the belt 5 to approximately one half their total length less the thickness of one belt layer. When the pins are so dimensioned the pins are tapped into the bricks until they abut with the end of a pin protruding from the layer below thus reducing the tolerance necessary in placing the pins in the layers.

The next layer of bricks 1 can now be placed on the pins 7 and tapped down on the pins to contact the belt 5. Preferably, an insert 2 is placed in position before an adjacent brick is laid. In order to facilitate the accommodation of the inserts 2 between the bricks 1 of a row it is preferable that the insert be of somewhat resilient material, such as sponge rubber, so that it can be compressed somewhat and still provide a good mortar-like seal between brick ends. The material of belts 5 should be of a material which has a slightly resilient surface so that the brick layer surface irregularities can be accommodated. However, the belts 5 should be able to withstand considerable weight pressure without unduly compressing so that the integrity of the brick wall construction can be maintained. A suitable material is corded belting having a substantially smooth, rubber-like, surface, which surface accommodates the minor irregularities of the brick surfaces contacting it. Such belting material is available as conveyor belts for ore handling in mineral mining operations.

Figure 3:
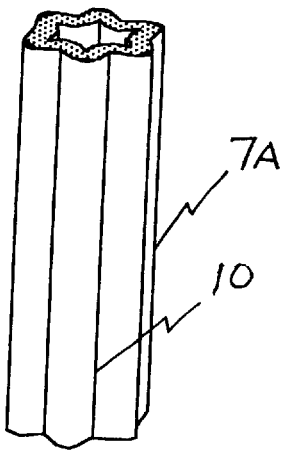
Figure 4:
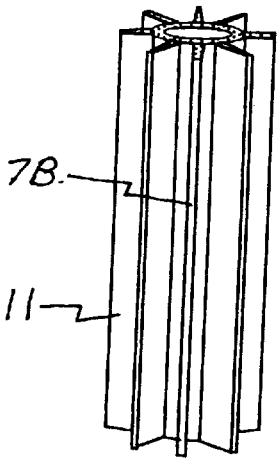
Figure 5:
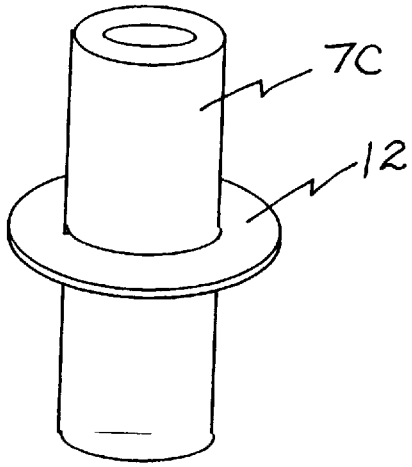

Referring to FIGS. 3, 4 and 5, variations of pins 7 are shown. A suitable construction 7A, shown in FIG. 3, has longitudinal convolutions 10 on its outer surface and of tubular form so that, when a wall is being constructed, steel reinforcing rods can be inserted into the wall vertically passing through the pins 7 of several layers of bricks 1. The material of the pins 7 may be polyethylene or a plastic material such as that known as ABS plastic which is used in plumbing construction and the wall of the tubing can be thin enough to provide flexibility for construction while still providing sufficient strength to prevent lateral movement of bricks with respect to the belt under normal stress conditions.

Another form of pin 7B is shown in FIG. 4 wherein the outer surface of the pin is provided with resilient, longitudinal, webs or fins 11 which provide tolerance for brick irregularities.

FIG. 5 shows a plain tubular pin 7C which is provided with a thin, longitudinally-central, encircling flange 12 which limits the penetration of the pin into a block or brick. Such pins can be shorter than the abutting types.

Although not shown, the pins can be solid but this form precludes the use of reinforcing rods and are wasteful of material. In all cases the pins should have sufficient strength to prevent collapsing when being tapped into position and to provide sufficient rigidity to the wall construction. The rigidity required will be dependent on the use and inadvertent forces to which the wall will be normally subjected.

Although a particular embodiment of the invention has been described, it will be obvious that different brick formats and consequent belt structures may be employed to construct walls according to the principles of the present invention. The use of short pins, according to the invention, provides ease and versatility of construction.

In drywall construction the level of a layer may be adjusted, in accordance with the invention, by the use of thin shim layers of belting, not shown, which can be placed on the belts where necessary to correct minor level discreprencies.

We claim:

1. A method of constructing a drywall having a mortared type appearance comprising, laying a horizontal row of bricks in end to end relationship, the bricks being provided with symmetrically and longitudinally spaced vertical holes passing therethrough, laying a belt on top of the row, the belt simulating a horizontal mortar layer and being provided with holes coinciding with the locations of the holes in the bricks and the spaces between abutting ends of the bricks in the row, inserting simulated, vertically oriented, mortar pads between the abutting ends of the bricks in the row, inserting short pins through the holes of the belt into the coincident holes of the bricks and leaving a portion of each pin projecting above the level of the belt, laying a further row of bricks over and onto the projecting ends of the pins in standard horizontally and longitudinally offset brick construction format and inserting simulated, vertically oriented mortar pads between the abutting ends of the bricks of said further row to form a vertical wall simulating standard brick format construction.

2. The method as claimed in claim 1 wherein the pins in each row are dimensioned in length to abut the ends of the pins of bricks of adjacent rows.

3. The method as claimed in claim 1 or 2 wherein the pins are tubular and reinforcing rods are inserted through the pins of the rows of bricks.

4. A drywall construction comprising:

a plurality of bricks, each brick having ends, upper and lower surfaces, and a plurality of holes extending from the upper surface to the lower surface, one of said holes being positioned in the center of each of the bricks, the bricks placed in end to end relationship adjacent one another in rows, and aid rows being vertically stacked, spacing pads placed vertically between adjacent bricks in each row, abutment spaces formed between adjacent bricks in each of the rows, a plurality of belts, one of the belts placed between each of the adjacent rows and abutting the surfaces of the bricks, each of the belts having holes therein, the holes of the belts being coincident with the holes of the bricks and the abutment space, and short pins dimensioned to fit into the holes of the bricks of adjacent rows, whereby displacement of the rows is prevented by the pins.

5. The drywall construction as claimed in claim 4 wherein the length of the pins is approximately equal to the thickness of one of the bricks and one belt combined.

6. The drywall construction as claimed in claim 4 wherein the spacing pads are provided with centrally located upper and lower tabs which are adapted to fit into the holes of the belt coinciding with the abutment spaces of one of the rows of bricks whereby the spacing pad is secured in position by the belt in combination with the pins securing the belt in position with respect to one of the rows of bricks.

7. The drywall construction as claimed in claim 4 wherein the pins are dimensioned to snugly fit within one of the holes of one of the bricks and are of tubular construction to allow the insertion of a reinforcing rod through pins in the wall construction.

8. The drywall construction as claimed in claim 4 wherein the belt is provided with a resilient upper and lower surface to accommodate slight irregularities in the surfaces of the bricks with which the belt comes in contact.

9. The drywall construction as claimed in claim 4 wherein the pins are provided with a longitudinally convoluted outer surface.

10. The drywall construction as claimed in claim 4 wherein the pins are provided with flexible, longitudinal, webs.

11. The drywall construction as claimed in claim 4 wherein the pins are each provided with an encircling flange limiting the depth of penetration of the pin into one of the rows of bricks and the belt.

* * * * *